US009120306B2

(12) United States Patent
Buschmann

(10) Patent No.: US 9,120,306 B2
(45) Date of Patent: Sep. 1, 2015

(54) METHOD TO EXECUTE A PRINT INTERRUPTION IN PRINTING OPERATION OF AN INK PRINTING SYSTEM WITH AT LEAST ONE PRINTING APPARATUS

(71) Applicant: Stefan Buschmann, Arenshausen (DE)

(72) Inventor: Stefan Buschmann, Arenshausen (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 0 days.

(21) Appl. No.: 14/049,285

(22) Filed: Oct. 9, 2013

(65) Prior Publication Data

US 2014/0176629 A1 Jun. 26, 2014

(30) Foreign Application Priority Data

Oct. 25, 2012 (DE) ..... 10 2012 110 187

(51) Int. Cl.
*B41J 2/045* (2006.01)
*B41J 11/42* (2006.01)
*B41J 15/04* (2006.01)

(52) U.S. Cl.
CPC ..... *B41J 2/04541* (2013.01); *B41J 11/42* (2013.01); *B41J 15/04* (2013.01)

(58) Field of Classification Search
CPC ..... B41J 2/04596; B41J 2/04598
See application file for complete search history.

(56) References Cited

U.S. PATENT DOCUMENTS

| | | | | |
|---|---|---|---|---|
| 2007/0052744 | A1 * | 3/2007 | Mitsuki et al. | 347/12 |
| 2007/0200885 | A1 * | 8/2007 | Hibi | 347/11 |
| 2009/0160887 | A1 | 6/2009 | Hamazaki et al. | |
| 2012/0182343 | A1 * | 7/2012 | Biglari et al. | 347/14 |

FOREIGN PATENT DOCUMENTS

| | | | |
|---|---|---|---|
| DE | 697 36 991 | | 11/2006 |
| DE | 10 2011 000 174 | | 7/2012 |
| EP | 0788882 | | 7/2002 |
| EP | 1795356 | | 6/2007 |
| EP | 1795356 | A1 * | 6/2007 |

* cited by examiner

*Primary Examiner* — Geoffrey Mruk
*Assistant Examiner* — Scott A Richmond
(74) *Attorney, Agent, or Firm* — Schiff Hardin LLP

(57) ABSTRACT

In a method to execute a printing interruption in a printing operation, with aid of a sensor, print clock pulses are generated which are supplied to a print controller depending on a feed speed of the printing substrate web. With triggering of the print interruption the feed speed of the printing substrate is reduced from a print speed to a predetermined speed in a slowing ramp, and after the print interruption the printing substrate is accelerated again to the print speed in an acceleration ramp. With aid of the sensor, print clock pulses are generated which are supplied to a print controller depending on the feed speed of the printing substrate. Given occurrence of a print clock pulse during the ramps, with the print controller a vibration cycle is initiated at nozzles of the print head that are not ejecting ink droplets at a time when the vibration cycle is initiated.

8 Claims, 2 Drawing Sheets

METHOD TO EXECUTE A PRINT INTERRUPTION IN PRINTING OPERATION OF AN INK PRINTING SYSTEM WITH AT LEAST ONE PRINTING APPARATUS

BACKGROUND

Ink printing apparatuses can be used for single-color or multicolor printing to a printing substrate (for example a single sheet or a web-shaped recording medium) made of the most varied materials (paper, for example). The design of such ink printing apparatuses is known; see for example EP 0 788 882 B1. Ink printing apparatuses that operate according to the Drop on Demand (DoD) principle have a print head or multiple print heads with nozzles comprising ink channels, the activators of which nozzles—controlled by a print controller—excite ink droplets in the direction of the printing substrate, which ink droplets are directed towards said printing substrate in order to apply print dots there for a print image. The print image can thereby be made up of image points (what are known as pixels) arranged like a raster. In the following, image points that have been inked by an ink droplet (inked image points) are designated as inked pixels or print points; image points that have not been inked (uninked image points) are called uninked pixels. The activators of the nozzles can generate ink droplets piezoelectrically (DE 697 36 991 T2), for example.

In an ink printing apparatus, the ink that is used is adapted in terms of its physical/chemical composition to the print head; for example the ink is adapted with regard to its viscosity. Given low printer utilization, in the printing process not all nozzles of the print head are activated; many nozzles have downtimes, with the consequence that the ink in the ink channel of these nozzles is not moved. Due to the effect of the evaporation out of the nozzle opening, the danger exists that the viscosity of the ink then changes. This has the result that the ink in the ink channel can no longer move optimally and exit from the nozzle. In extreme cases, the ink in the ink channel dries up completely and blocks the ink channel, such that a printing with this nozzle is no longer possible.

A drying of the ink in the nozzles of a print head during their print pause represents a problem that can be prevented in that a flushing medium (for example ink or cleaning fluid) is flushed through all nozzles within a predetermined cycle. This flushing cycle can be set corresponding to the print utilization.

Furthermore, from DE 697 36 991 T2 (EP 0 788 882 B1) it is known to remedy difficulties caused by the change of the viscosity of the ink in the nozzles upon the ejection of ink droplets in that the piezoelectric activators of the nozzles are respectively vibrated before or after the printing process (also called prefire or meniscus vibrations), such that no ink droplets are ejected but the ink in the nozzles is stirred. It can thereby be achieved that the ink situated at the nozzle openings mixes with the ink located inside the piezoelectric activator, such that the ink droplets can be generated again under normal conditions in the printing operation.

In the printing of a printing substrate it is sometimes necessary to briefly interrupt the printing operation (for example for 3 min), for example in order to monitor the register quality after proofing a print job or in order to correct problems in the post-processing of the printing substrate. The feed speed of the printing substrate can thereby be reduced up to a complete stop in a slowing ramp and be accelerated again in an acceleration ramp after a wait time (of 3 min, for example). During the slowing time period of the printing substrate before the print interruption and the acceleration of the printing substrate after the print interruption, printing can be continued, wherein the time intervals between the print clock pulses (and therefore between the emissions of ink droplets) increase or decrease during the ramps. During the duration of the ramps, the problem of ink drying out in the nozzles of the print heads are then intensified, with the consequence that printing can no longer be conducted sufficiently well.

SUMMARY

It is an object to specify a method that ensures that, before and after a print interruption in which the printing substrate is braked from a printing speed to a standstill and is subsequently accelerated to printing speed again in ramps, and in which printing is continued during the ramps, a change of the viscosity of the ink in the nozzles of a print head (in particular at the nozzle openings) that prevents the ejection of ink droplets after the end of the interruption is avoided.

In a method to execute a printing interruption in a printing operation, with aid of a sensor, print clock pulses are generated which are supplied to a print controller depending on a feed speed of the printing substrate web. With triggering of the print interruption the feed speed of the printing substrate is reduced from a print speed to a predetermined speed in a slowing ramp, and after the print interruption the printing substrate is accelerated again to the print speed in an acceleration ramp. With aid of the sensor, print clock pulses are generated which are supplied to a print controller depending on the feed speed of the printing substrate. Given occurrence of a print clock pulse during the ramps, with the print controller a vibration cycle is initiated at nozzles of the print head that are not ejecting ink droplets at a time when the vibration cycle is initiated.

DESCRIPTION OF EXEMPLARY EMBODIMENTS

Figure 1:
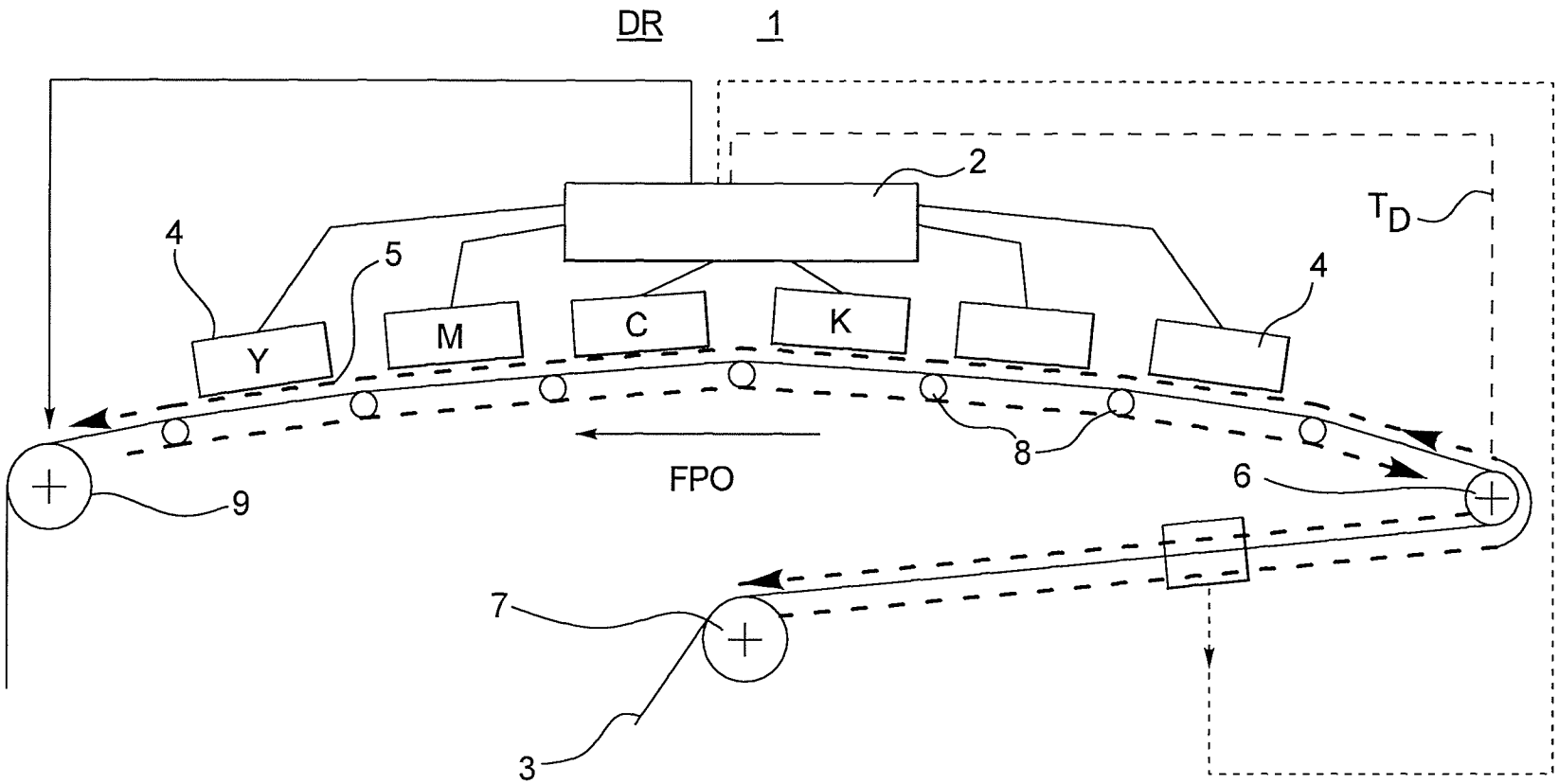
FIG. 1 (PRIOR ART)
FIG. 1 is a representation of a printing unit of an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In the method, before and after a print interruption the feed speed of the printing substrate is braked from the speed in the printing operation (print speed) to a predetermined speed or to a standstill, and is accelerated to print speed again after the end of the print interruption. Printing clock pulses are generated with a sensor (for example with an encoder roller driven by the printing substrate) depending on the feed of said printing substrate, which printing clock pulses are supplied to a print controller. Given the occurrence of a printing clock pulse, the print controller can send at least one vibration pulse (for example according to an algorithm stored here) to the print heads at predetermined points in time, based on which vibration pulse the print heads execute a vibration cycle made up of vibration oscillations. The vibration pulses can also be triggered only for a time portion of the ramps, for example if the speed of the printing substrate has decreased to less than 90% of the print speed. For example, the algorithm can selectively induce the triggering of vibration cycles depending on the design of the print image, for example depending on the distribution of the uninked pixels in the print image or depending on the speed of the printing substrate during the ramps.

If there exists a danger of a change of the viscosity of the ink during the slowing phase or acceleration phase, the prefire functionality of the printing apparatus can be utilized. For this, at least one vibration cycle can be triggered according to the predetermined algorithm given a print image raster made up of image points in the region of the uninked pixels (image points in which no ink droplets are ejected). For example, the algorithm can be provided such that a vibration cycle is triggered given the occurrence of uninked pixels in every raster column or every second raster column of the print image. The triggering of vibrations can thereby be adapted to the print speed, in that more or fewer uninked pixels are replaced by a vibration cycle. For example, the frequency of vibration cycles can thereby be increased with decreasing print speed since the time between the print clock pulses increases, and therefore the drying effect is greater. In the extreme case, all uninked pixels can be replaced with vibration cycles.

The method according to the exemplary embodiment thereby has the following advantages:

The reliability of the printing during the ramps—i.e. the slowing and acceleration phases—is increased; no data loss occurs.

Printing with ink that dries quickly is possible during the ramps.

The exemplary embodiment can be realized at low cost.

The exemplary embodiment is explained further using FIGS. 3 through 6.

In FIGS. 3 through 6, the image points of a print image are shown as squares for the simplification of the depiction, without the shapes of the image points or pixels thereby being established. Furthermore, the print direction is designated with PF1 in FIGS. 3 through 6.

The aforementioned problems given a print interruption are explained further using FIG. 1. A printing substrate web 3 is thereby used as a printing substrate, without the exemplary embodiment thereby being limited to a printing substrate web. In addition to this, in the exemplary embodiment it is assumed that the printing unit can have a plurality of print heads. However, the statements also apply if the printing unit provides only one print head.

A printing unit 1 and a print controller 2 of a printing apparatus DR are shown. The printing unit 1 is arranged along a printing substrate web 3, which printing unit 1 has print bars 4 with print heads 5 in series as viewed in the transport direction PF0 of the printing substrate web 3, wherein the print heads 5 respectively provide nozzles via which the ink droplets can be ejected. Given color printing, for example, a respective print bar 4 can be provided per color to be printed. The printing substrate web 3 is moved past the print bars 4 with the aid of a take-up roller 9; it thereby lies on a saddle with guide rollers 8. A sensor 6 is arranged at the intake of the printing unit 1, which sensor 6 generates print clock pulses TD depending on the feed speed of the printing substrate web 3, which print clock pulses TD are supplied to the print controller 2 and are used by said print controller 2 to—for example—establish the point in time of the ejection of ink droplets at the nozzles of the individual print heads 5. For example, the sensor can be executed as a rotary encoder or encoder roller 6 which is driven by the printing substrate web 3.

Figure 2:
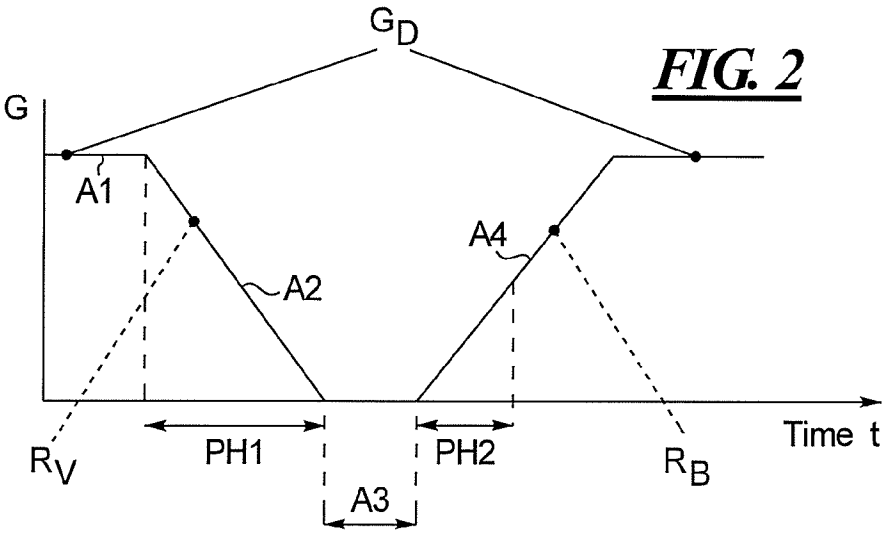
FIG. 2 is a representation of the feed speed of the printing substrate web before and after a print interruption.

According to FIG. 2, print clock pulses TD are generated by the encoder roller 6 synchronously with the feed of the printing substrate web 3, which means that one print clock pulse TD is emitted by the encoder roller 6 to the print controller 2 per pixel of a character to be printed, for example. After every print clock pulse TD, said print controller can supply print data to the respective print head 5 and then trigger the emission of ink droplets. The print heads 5 have (in a known manner) nozzles with ink channels that, for example, can generate ink droplets with a piezoelectric activator according to the DoD principle, which ink droplets are directed towards the printing substrate web 3 in order to generate an inked image point or pixel there. The printing substrate web 3 is thereby supplied to the encoder roller 6 via a drive roller 7 arranged before said encoder roller 6.

If the printing operation is interrupted, the problems illustrated above occur during the slowing phase and acceleration phase. In both cases, during these phases the printing substrate web 3 moves, with the consequence that the encoder roller 6 emits print clock pulses TD. Print-start signals are then supplied to the respective print heads 5 for which print data DA exist, such that the nozzles of the print head 5 eject ink droplets onto the printing substrate web 3 in continued printing if inked pixels in the print image should be generated on the printing substrate web 3, while the respective nozzles of the print head 5 are not activated given uninked pixels of the print image. However, since the time interval between the print clock pulses TD in the phase in which the printing substrate web 3 is slowed is always greater in comparison to the printing operation, the danger exists that the viscosity of the ink in the nozzle openings has changed gradually, such that ink droplets cannot be generated properly by the piezoelectric activators. The time interval of the print clock pulses TD accordingly decreases during the acceleration phase so that the viscosity of the ink may have changed at the beginning of the acceleration after the print interruption such that the ejection of ink droplets from the print heads is disrupted.

Figure 3:
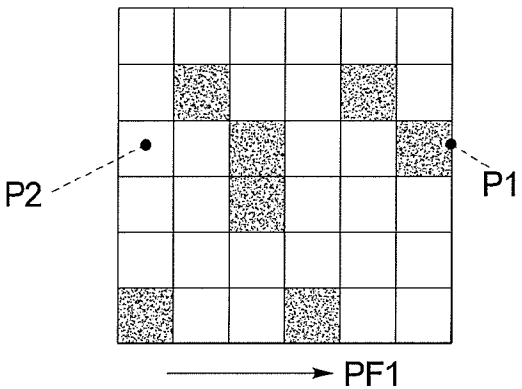
FIG. 3 is a representation of a print image raster made up of inked and uninked pixels.

The curve of the velocity G of the printing substrate web 3 is plotted over time t in a print interruption using FIG. 3. The printing substrate web 3 with print speed $G_D$ is transported (Segment A1) until a print interruption should be triggered. The printing substrate web 3 is subsequently braked and brought to a standstill in a slowing ramp $R_V$ (Segment A2). After the print interruption (Segment A3), the printing substrate web 3 is accelerated from the standstill to the print speed $G_D$ again in an acceleration ramp $R_B$ (Segment A4).

For example, a print image generated by a print head 5 can be constructed corresponding to FIG. 3. In a principle presentation, FIG. 3 has a raster of image points (pixels P) that can be filled with ink droplets by the nozzles of the print head 5, corresponding to the print job. FIG. 3 shows a print image at print speed in which the image points arranged like a raster are inked with ink droplets (inked pixels P1) or are not inked (uninked pixels P2). From FIG. 3 it can be learned that, given the generation of the print image, a portion of the nozzles of a print head 5 is activated, thus ink droplets are ejected to generate inked pixels P1; in contrast to this, the remainder of the nozzles are deactivated since the associated image points at the print image are not inked, and thus are represented as uninked pixels P2. In order to counteract the effect of the drying of ink in the unactivated nozzles, vibration cycles can be generated in the unactivated nozzles in a known manner according to a predeterminable algorithm (stored in the printer controller 2, for example) in the time period of the uninked pixels P2 in the print image.

Since a plurality of vibration oscillations are executed in a vibration cycle, a vibration cycle can be implemented only when the time period that is provided for the uninked pixels P2 allows this. Whether this is the case depends on the speed G of the printing substrate web 3. For example, at high velocity G the triggering of a vibration cycle can therefore be reasonable only when the speed G of the printing substrate web 3 has already been partially reduced and the time interval of the print clock pulse TD has reached a predetermined value, for example when the velocity G of the printing substrate web 3 has decreased to 90% of the print speed GD (phase PH1, FIG. 2) or the printing substrate web 3 has not yet reached 90% of the print speed GD in the acceleration ramp RB, for example (phase PH2, FIG. 2).

Figure 4:
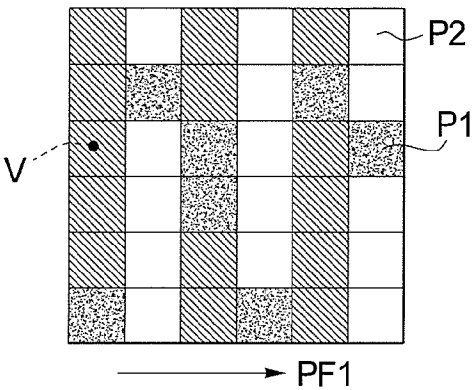
FIGS. 4 through 6 are representations of the print image raster according to FIG. 3 in which uninked pixels have been replaced with vibration cycles.
Figure 5:
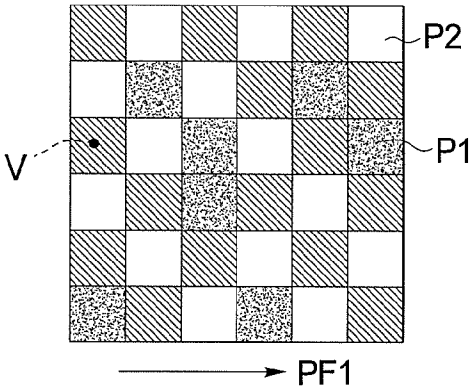
Figure 6:
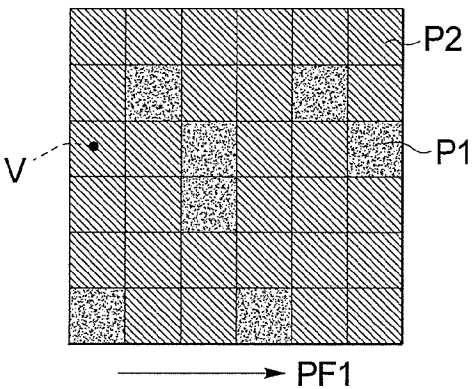

Examples for the generation of vibration cycles V result from FIGS. 4 through 6 in a print image raster corresponding to FIG. 3 in which uninked pixels P2 are present. The corresponding pixels P2 in the print image raster are shown uninked. FIG. 4 shows an example in which the uninked pixels P2 of every second column of image points are provided for a vibration cycle V. In FIG. 5, 50% of the uninked pixels P2 of the print image raster are respectively utilized for a vibration cycle V. Finally, FIG. 6 shows the case that all uninked pixels P2 of the print image raster are respectively provided for a vibration cycle V.

Respective examples for the use of vibration cycles V during the time of the occurrence of uninked pixels P2 in the print image are shown in FIGS. 4 through 6. A vibration cycle V can thereby have an adjustable number of oscillations that, for example, can be dependent on the feed speed G of the printing substrate web 3 during the braking phase $R_V$ or acceleration phase $R_B$. The feed speed G can be measured with the aid of the encoder roller 6, for example. In the printer controller 2, an algorithm can accordingly be realized as software via which the nozzles of the print heads 5 are activated such that they induce the triggering of vibration cycles V depending on the speed G of the printing substrate web 3 or depending on the distribution of the uninked pixels P2 in the print image.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to execute a print interruption in a printing operation of an ink printing system with at least one printing apparatus, a printing substrate being printed to with a printing unit with at least one print head, and wherein the respective print image is generated by at least one nozzle of the print head from image points arranged like a raster, comprising the steps of:

with aid of a sensor, generating print clock pulses supplied to a print controller depending on a feed speed of the printing substrate;

with triggering of the print interruption reducing the feed speed of the printing substrate from a print speed in the printing operation to a predetermined speed in a slowing ramp, and after the print interruption accelerating again to said print speed in an acceleration ramp;

given occurrence of a print clock pulse during the ramps, with the print controller adjustably initiating a vibration cycle of vibration oscillations only at a time of said given occurrence of the print clock pulse at said at least one nozzle of the print head that is not ejecting an ink droplet at a time when the vibration cycle is initiated; and generating the vibration cycle at said at least one nozzle only if a time interval of the print clock pulses relative to one another reaches a predetermined value.

2. The method according to claim 1 in which a first vibration cycle is generated only when the feed speed of the printing substrate has reached 90% of the print speed.

3. The method according to claim 2 in which uninked image points of every second column of image points of a print image are replaced with a respective vibration cycle.

4. The method according to claim 2 in which 50% of uninked image points of a print image are replaced by a respective vibration cycle.

5. The method according claim 2 in which all uninked image points of a print image are respectively replaced by a vibration cycle.

6. The method according to claim 1 in which the printing unit has a plurality of print heads, a print-start signal is supplied to the print heads given occurrence of print clock pulses during the ramps, wherein an at least one nozzle of the print heads that should generate an image point to be inked eject an ink droplet, and a vibration cycle is selectively triggered at the at least one nozzle that should not generate an image point to be inked.

7. The method according to claim 1 in which an algorithm is stored in the printer controller, with the printer controller the at least one nozzle of the print head is controlled such that the at least one nozzle that does not ink an image point selectively executes a vibration cycle, and wherein a number of vibration oscillations per vibration cycle is adjustable.

8. The method according to claim 7 in which a number of vibration oscillations per vibration cycle during the ramps is dependent on the feed speed of the printing substrate.

* * * * *